United States Patent [19]

Aflitto

[11] Patent Number: 4,562,601

[45] Date of Patent: Jan. 7, 1986

[54] TOILET AID

[76] Inventor: Charles Aflitto, 1950 W. Aster, No. E5, Phoenix, Ariz. 85029

[21] Appl. No.: 672,468

[22] Filed: Nov. 19, 1984

[51] Int. Cl.[4] ..... E03D 5/00

[52] U.S. Cl. ..... 4/249; 4/405; 4/661; 74/515 E; 74/554

[58] Field of Search ..... 4/661, 300, 308, 353, 4/249, 405; 74/515 E, 554

[56] References Cited

U.S. PATENT DOCUMENTS

| | | | |
|---|---|---|---|
| 1,326,377 | 12/1919 | Stocking et al. | 74/515 E |
| 1,585,557 | 5/1926 | Miller | 4/249 |
| 2,204,867 | 6/1940 | Rehback | 4/249 UX |
| 2,605,479 | 8/1952 | Ansorge | 4/249 |
| 2,862,212 | 12/1958 | Holl | 4/249 |
| 2,908,915 | 10/1959 | Holl | 4/249 |
| 2,942,909 | 6/1960 | Chase | 74/515 E |
| 3,045,248 | 7/1962 | Gentry | 4/249 X |
| 3,883,904 | 5/1975 | Wittman | 4/249 |
| 3,925,832 | 12/1975 | Falzone | 4/249 |
| 4,007,499 | 2/1977 | Lin | 4/249 |

*Primary Examiner*—Henry K. Artis

*Attorney, Agent, or Firm*—Robert A. Hirschfeld; James F. Duffy

[57] ABSTRACT

A protruding lever is releasably attached to a conventional flush-tank pivoted flush handle, extending toward a locus of the user's convenient arm flexure. The user is thereby enabled to actuate the flush lever without contortion from conventional seated position. The invention swings away from the user when inadvertently contacted, while retaining rigidity in the direction of flush actuation. An elbow-conformal recess facilitates confortable actuation by the user's elbow. The invention is releasably clamped to and wholly supported by the conventional flush handle.

7 Claims, 6 Drawing Figures

TOILET AID

BACKGROUND OF THE INVENTION

1. Technical Field

The invention relates to an aid for actuation of a conventional flush-tank pivoted flush handle.

More particularly, the invention relates to an aid for actuation of a conventional flush-tank pivoted flush handle by a conventionally seated user which avoids user contortion usually resulting from flush handle location behind the user's torso.

2. Prior Art

Conventional flush-tank pivoted flush handles are located behind the torso of a conventionally seated user, usually adjacent one of the user's shoulders. A seated user seeking to remain seated while actuating the flush handle is obliged to uncomfortably contort his arm and torso. A user whose forearm or hand is amputated finds seated actuation of a conventional flush-tank pivoted flush handle particularly difficult.

In the prior art, U.S. Pat. No. 2,862,212, C. B. Holl exemplifies a tank-mounted linkage manually actuable at a locus near the toilet bowl rim. U.S. Pat. No. 3,883,904, Wittman, exemplifies one of many pedal-actuable linkages. Common to prior art flushing aids is mechanical pendency to a portion of the toilet tank or bowl, or to the adjacent wall or floor, for provision of fulcrum, pivot or sliding guide force. Such prior art further relies upon complex linkages and a plurality of moving parts, and therefore is expensive to manufacture and install.

A simple, inexpensive toilet aid was needed which extended the locus of flush handle actuation to more comfortable bounds of user arm disposition, avoiding contortion by a conventionally seated user. A need further existed for a toilet aid which, although extended into such comfortable bounds, would not rigidly protrude against the user's body while assuming or arising from the seated position.

Therefore, it is an object of the invention to provide a toilet aid actuatable by a portion of the user's arm within the arm's comfortable flexure locus without contortion, to actuate a flush handle.

A further object of the invention is to provide a toilet aid actuatable by the user's elbow within the arm's comfortable flexure locus without contortion, to actuate a flush handle.

Another object of the invention is to provide a toilet aid which, although extended into comfortable bounds of user arm disposition, does not rigidly protrude against the user's body while assuming or arising from seated position.

Still another object of the invention is to provide a toilet aid to actuate a flush handle wholly supported by the flush handle and requiring no additional attachment to or support by the toilet bowl, flush tank, adjacent floor or wall.

It is a further object of the invention to provide a toilet aid to actuate a flush handle releasably attachable to dimensionally various flush handles.

DISCLOSURE OF THE INVENTION

A protruding lever is releasably attached to a conventional flush-tank pivoted flush handle adjacent the handle actuation end. The lever in use extends parallel the handle's pivot axis in a plane defined by the pivot axis and the handle actuation end, toward a locus of the user's comfortable arm flexure, where the user, by depressing a lever actuation end causes a corresponding downward force upon the handle actuation end.

To avoid rigid protrusion against the user's body while assuming or arising from seated position, an embodiment of the invention has adjacent the juncture of the lever and the flush handle a hinge and return spring, so that lateral displacement is accommodated while retaining rigidity in the direction of flush handle actuation. In another embodiment, the lever is flexible in the direction of lateral displacement while inflexible so as to transmit flush handle actuation force in the direction of actuation.

In an embodiment for actuation by the user's elbow, an elbow-conformal recess is disclosed adjacent the lever actuation end.

Clamping attachment of the lever to the flush handle accommodates flush handles of various dimensions by a plurality of clamp screws.

BEST MODE FOR CARRYING OUT THE INVENTION

Figure 1:
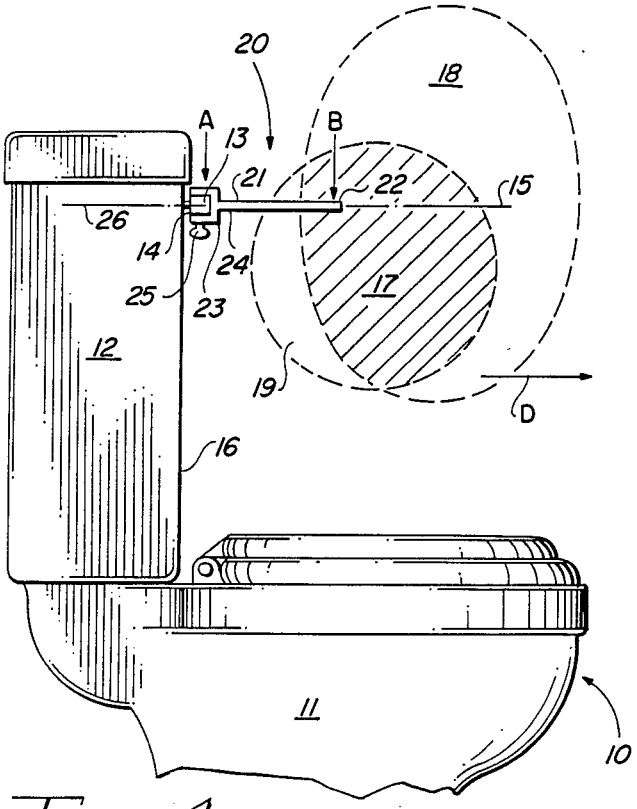
FIG. 1 is a side elevation view of a conventional flush-tank type toilet embodying the present invention.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

Figure 2:
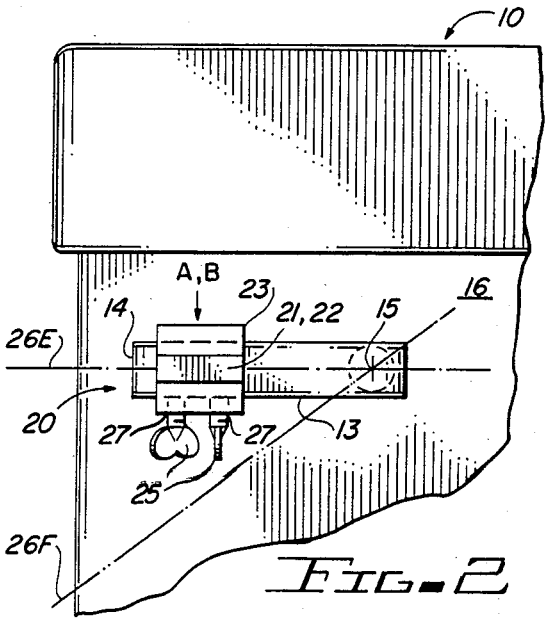
FIG. 2 is a partial front elevation view along lines 2—2 of FIG. 1.

FIG. 1 illustrates in side elevation view a conventional tank-type flush toilet generally referred to as 10 having a bowl 11, a tank 12 generally behind a conventionally seated user (not shown), a conventional flush handle 13 having an actuation end 14 (more clearly shown in the front view of FIG. 2) downwardly rotatable about a handle pivot axis 15. When conventionally seated, a user (not shown) faces away from tank 12 generally in frontal direction D, with the back of the user's torso generally parallel the front 16 of tank 12. A locus 17 is defined of comfortable arm flexure within the bounds of which at least one portion of the user's arm is available when in conventionally seated position for flush actuation. Because locus 17 is defined for any anticipated user, it may be seen that locus 17 is bounded by the comfortable arm flexure loci of a variety of users, exemplified by tall user locus 18 and child user locus 19. Thus, locus 17 is the one locus of coincidence of all intended user confortable arm flexure loci.

The present invention is generally referred to as 20. Lever means 21 has a lever actuation end 22 within the comfortable arm flexure locus 17. Attachment means 23 at attachment end 24 of lever means 21 is shown clamped by screw means 25 coactive with threaded hole means 27 through attachment means 23, to flush handle 13 adjacent handle actuation end 14. A pivotable plane 26 is defined as passing through flush handle pivot axis 15 and handle actuation end 14. In the conventional tank-type flush toilet configuration shown in FIGS. 1 and 2, pivotal plane 26 is approximately horizontal prior to and after return from flush actuation, and is canted about handle pivot axis 15 during actuation, respectively shown in FIG. 2 as conditions 26-E and 26-F. Pivotal plane 26 generally passes through lever means 21; thus actuation force A applied to lever actuation end 22 is translated into actuation force B adjacent flush handle actuation end 14, resulting in flush handle actuation. The entire lever means 21 and attachment means 23 travelling downward as pivotal plane 26 is canted.

Figure 3:
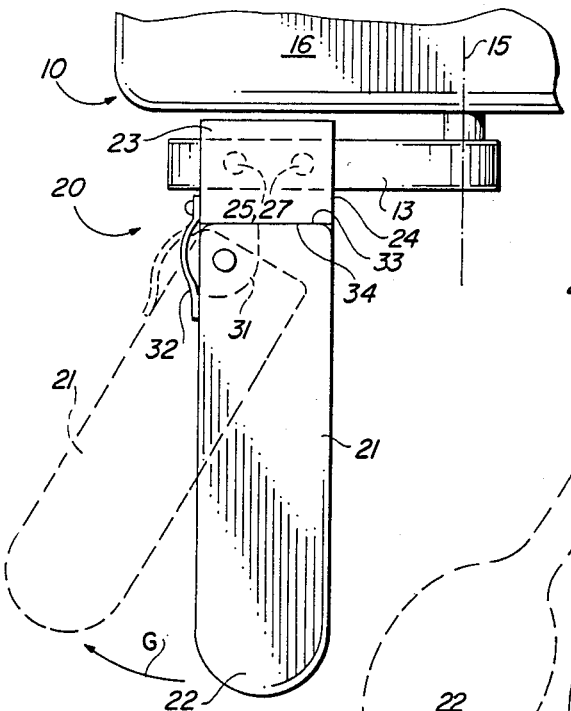
FIG. 3 is a top elevational view of an embodiment of the invention illustrating spring and hinge means for accommodating lateral displacement.

Referring to FIG. 3, an embodiment of toilet aid 20 is illustrated having hinge means 31. Lever means 21 when inadvertently contacting the user's torso, such as when the user sits down or arises, swings outward in direction G from the position illustrated in FIG. 3, usually parallel flush handle axis 15 within pivotal plane 26 (defined in FIGS. 1, 2, not shown in FIG. 3). Spring means 32 urges lever means 21 to return from its swung-out displacement to a normal operating position defined by abutment of lever stop surface 34 against attachment means stop surface 33.

Hinge means 31 is disposed to permit lever means 21 to swing outward while remaining in pivotal plane 26. Thus, downward force at lever actuation end 22 is transmitted through hinge means 31 to urge flush handle actuation end 14 downward.

Figure 6:
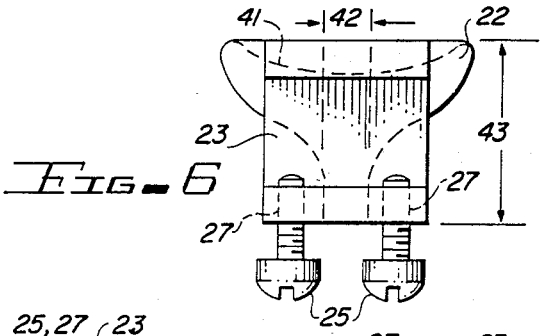
FIGS. 4, 5 and 6 are respectively top, side and rear elevational views of a flexible embodiment of the invention illustrating an elbow-conformal recess.
Figure 4:
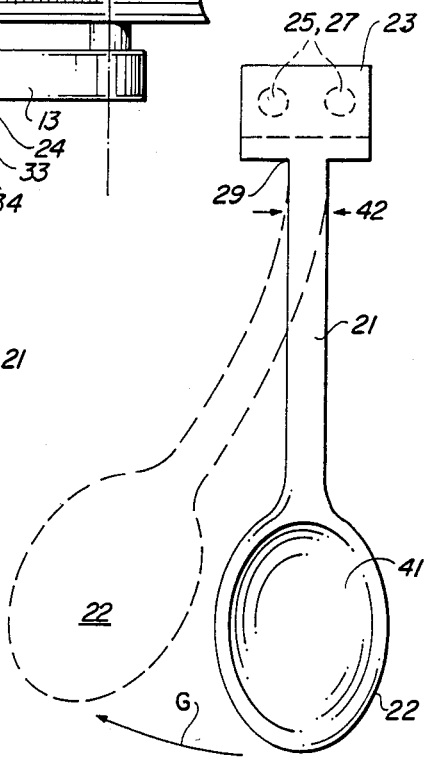
Figure 5:
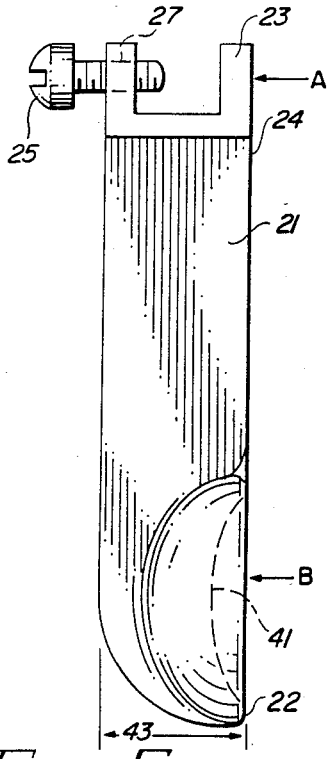

The embodiment shown in FIGS. 4, 5 and 6 achieves the same end result as that of FIG. 3, by permitting flexure of lever means 21 in direction G, while resisting flexure in the direction of actuation A,B. Lever means 21 has a narrow cross section 42 effectively creating a high modulus of elasticity in direction G, whereas the cross section 43 in the direction of actuation, A,B is wide, and therefore has a low modulus of elasticity in direction A,B. A suitable material for the embodiment of FIGS. 4, 5 and 6 would be rubber, flexible plastic and the like, as is well known in the art.

FIGS. 4, 5 and 6 also illustrate an elbow conformal recess 41 adjacent lever actuation end 22, for coaction with the user's elbow in transmitting actuation force B to lever means 21. Elbow conformal recess 41 also is illustrative of a relatively large and comfortable target area for coaction with any convenient portion of the user's arm.

Those skilled in the art will readily derive other embodiments of the invention drawn from the teachings herein. To the extent that such alternative embodiments are so drawn, it is intended that they shall fall within the ambit of protection provided by the claims appended hereto:

Having described my invention in the foregoing specification and the accompanying drawings in such a clear and concise manner that those skilled in the art may readily understand and easily practice the invention, I claim:

1. A toilet aid for improved actuation of a conventional flush-tank pivoted flush handle, said flush handle having a handle actuation end downwardly actuable by rotation of said flush handle in a plane parallel a conventionally seated user's torso, said rotation about a pivot axis adjacent an arm of said conventionally seated user, said arm defining an uncontorted flexure locus, said toilet aid comprising:

lever means extending from an attachment end adjacent said handle actuation end to a lever actuation end, said lever actuation end bounded by said uncontorted flexure locus; and attachment means coupled to said lever means adjacent said attachment end and to said flush handle adjacent said handle actuation end, said lever means fixed by said attachment means within a pivotal plane, said pivotal plane defined by said pivot axis and said handle actuation end.

2. A toilet aid according to claim 1 wherein said lever actuation end is bounded by an elbow locus of said arm of said conventionally seated user, said elbow locus bounded by said uncontorted flexure locus, said lever actuation end having an elbow-conformal recess for comfortable actuation of said toilet aid by said elbow of said conventionally seated user.

3. A toilet aid according to claim 1 wherein said attachment means comprises hinge means and return spring means, said lever means in a first position parallel said pivot axis of said flush handle, said lever means outwardly displaceable within said pivotal plane about said hinge means in a second position, said lever means urged by said return spring means toward said first position, for transmission of downward actuation force from said lever actuation end to said flush handle and for accommodating inadvertent lateral displacement by said conventionally seated user.

4. A toilet aid according to claim 1 wherein said lever means has low modulus of elasticity in a direction orthogonal said pivotal plane and high modulus of elasticity in a direction outward of said pivot axis of said flush handle parallel said pivotal plane, for transmission of downward actuation force from said lever actuation end to said flush handle and for accommodating inadvertent lateral displacement by said conventionally seated user.

5. A toilet aid according to claim 4 wherein said low modulus of elasticity corresponds to a deep cross-sectional profile of said lever means and said high modulus of elasticity corresponds to a narrow cross-sectional profile of said lever means.

6. A toilet aid according to claim 1 wherein said attachment means comprises releasable clamp means.

7. A toilet aid according to claim 6 wherein said releasable clamp means comprises a plurality of screw means for accommodating dimensional variations in said flush handle.

* * * * *